US008339327B2

(12) United States Patent
Schadler et al.

(10) Patent No.: US 8,339,327 B2
(45) Date of Patent: Dec. 25, 2012

(54) CIRCULARLY-POLARIZED ANTENNA

(75) Inventors: John L. Schadler, Raymond, ME (US); Andre Skalina, Portland, ME (US)

(73) Assignee: SPX Corporation, Charlotte, NC (US)

( * ) Notice: Subject to any disclaimer, the term of this patent is extended or adjusted under 35 U.S.C. 154(b) by 299 days.

(21) Appl. No.: 12/793,529

(22) Filed: Jun. 3, 2010

(65) Prior Publication Data

US 2011/0134008 A1 Jun. 9, 2011

Related U.S. Application Data

(60) Provisional application No. 61/183,734, filed on Jun. 3, 2009.

(51) Int. Cl.
*H01Q 19/10* (2006.01)
*H01Q 21/00* (2006.01)

(52) U.S. Cl. ... 343/834; 343/835; 343/853; 343/700 MS

(58) Field of Classification Search ..... 343/700 MS, 343/816, 820, 824, 853, 834, 835, 833
See application file for complete search history.

(56) References Cited

U.S. PATENT DOCUMENTS

| | | | | |
|---|---|---|---|---|
| 5,309,164 | A * | 5/1994 | Dienes et al. | 343/700 MS |
| 5,572,222 | A * | 11/1996 | Mailandt et al. | 343/700 MS |
| 5,757,246 | A * | 5/1998 | Johnson | 333/12 |
| 6,388,622 | B1 * | 5/2002 | Jennetti et al. | 343/700 MS |
| 6,448,930 | B1 * | 9/2002 | Judd | 343/700 MS |
| 8,102,326 | B2 * | 1/2012 | Schadler et al. | 343/797 |
| 2007/0046547 | A1 | 3/2007 | Crouch | |
| 2008/0036665 | A1 * | 2/2008 | Schadler | 343/700 MS |
| 2008/0074324 | A1 | 3/2008 | Puzella et al. | |
| 2008/0191953 | A1 | 8/2008 | Bruno et al. | |

* cited by examiner

*Primary Examiner* — Hoang V Nguyen
(74) *Attorney, Agent, or Firm* — Baker & Hostetler, LLP

(57) ABSTRACT

A circularly-polarized antenna is provided, and includes a conductive backplane with a plurality of panels, a vertical array of patch radiators disposed on one of the backplane panels, and a feed stripline disposed on the backplane panel. The backplane panels are vertical, planar, rectangular and form a right prism. The vertical array has a radiator spacing of one wavelength, each radiator has a face and four edges, and each edge has a length of approximately one half wavelength. The feed stripline includes an input coupled to a coaxial feed cable, and a pair of outputs, orthogonal in position and phase, coupled to each of the radiators.

11 Claims, 12 Drawing Sheets

FIG. 4
FIG. 4A
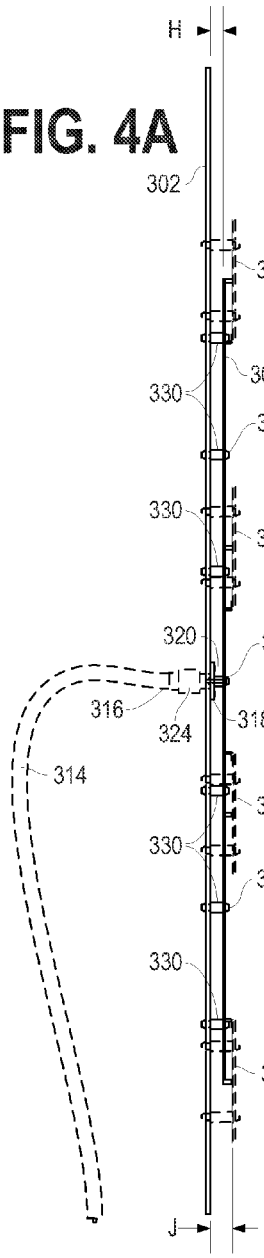
FIG. 4B
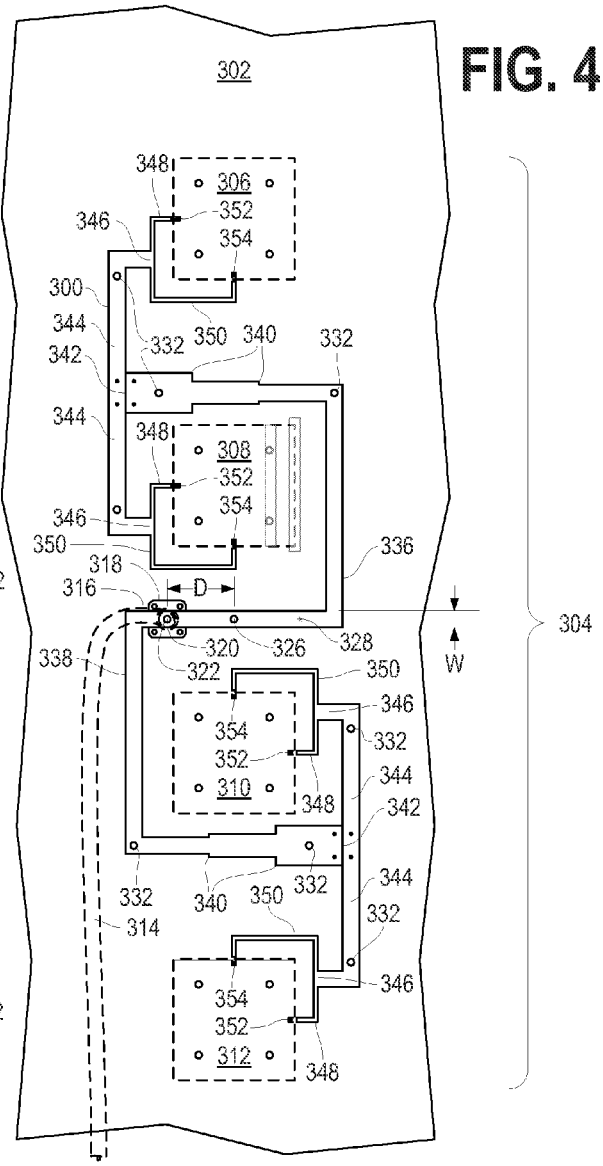

FIG. 7
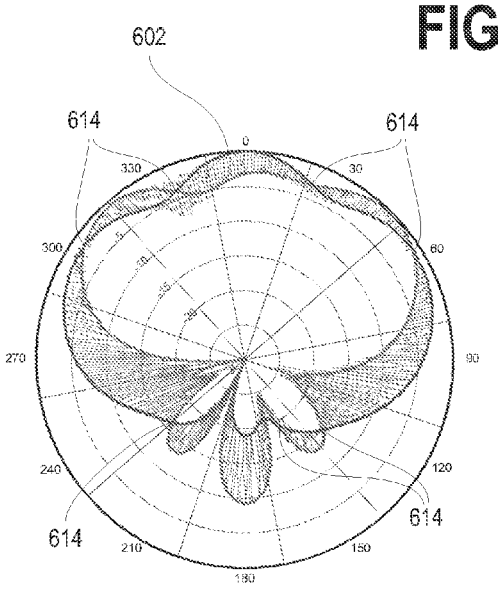
FIG. 7A
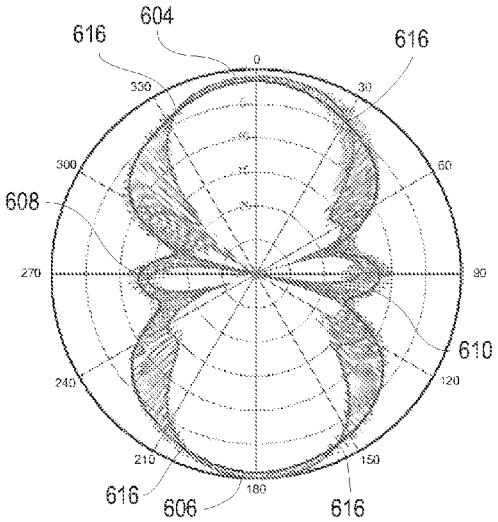
FIG. 7B
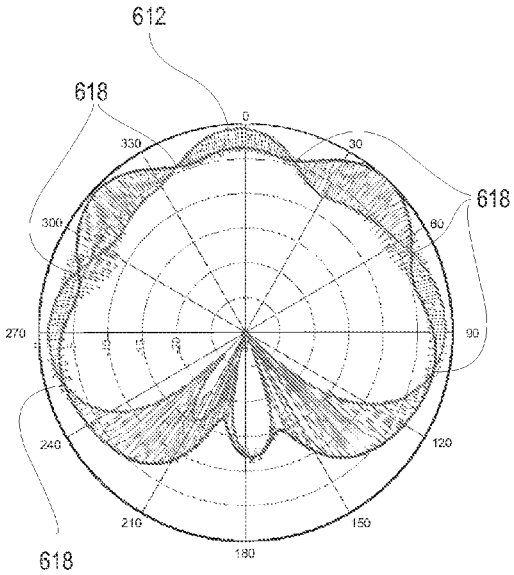
FIG. 7C
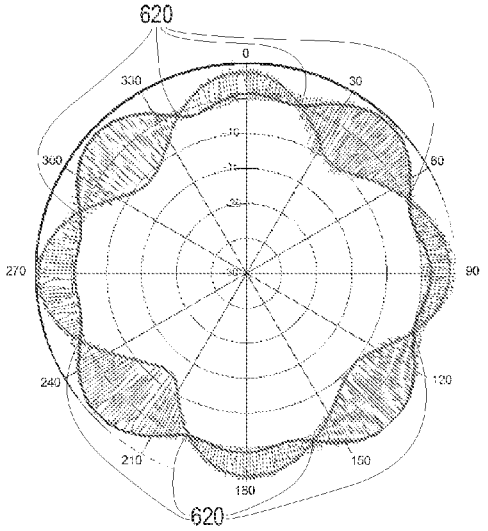
FIG. 7D FIG. 8
FIG. 8A
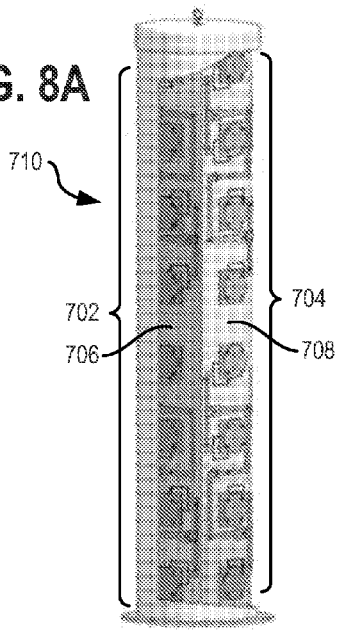
FIG. 8B
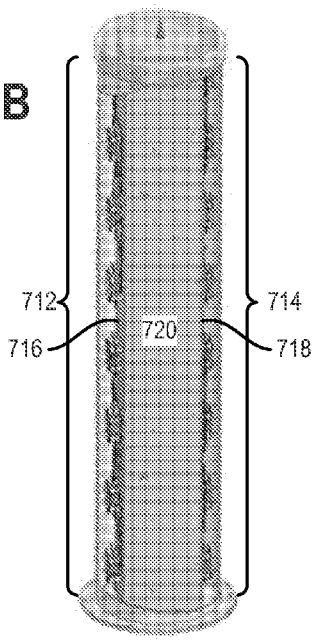
FIG. 8C
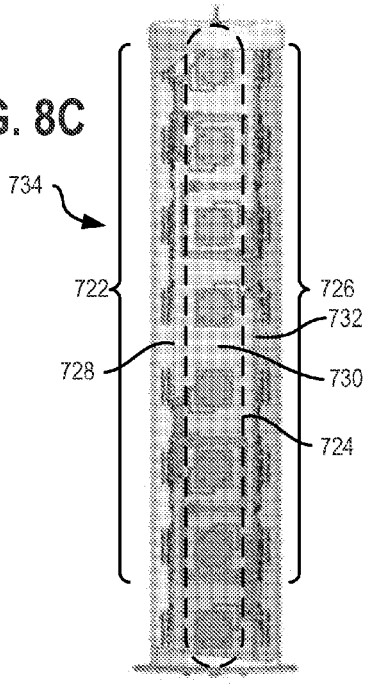
FIG. 8D
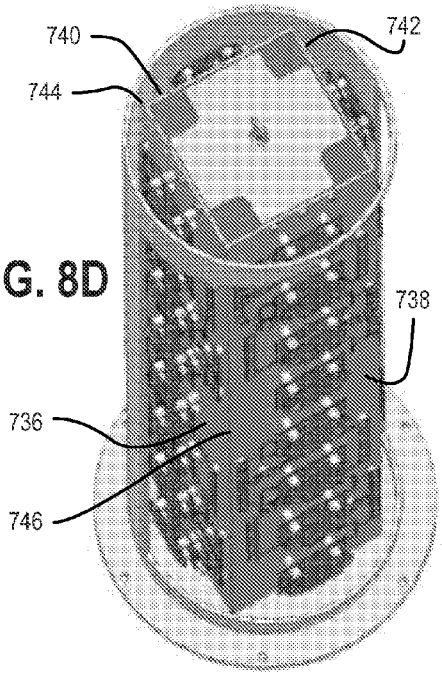

FIG. 11
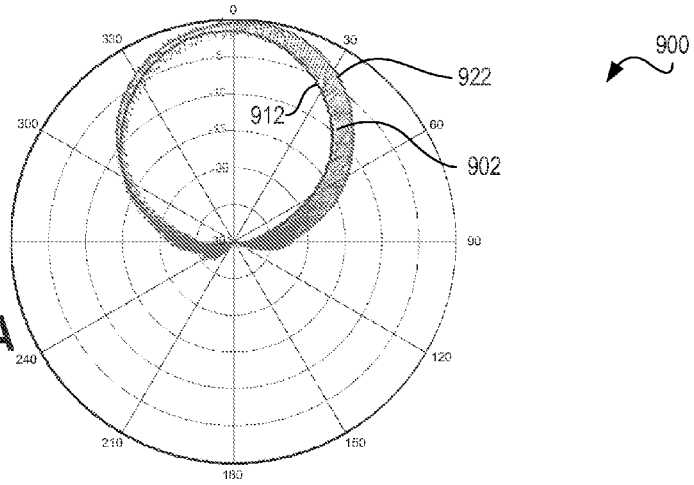
FIG. 11A
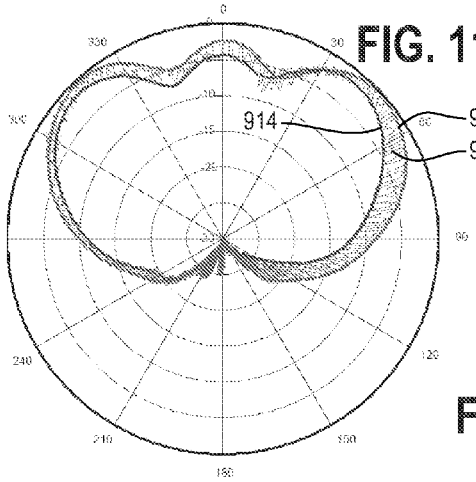
FIG. 11B
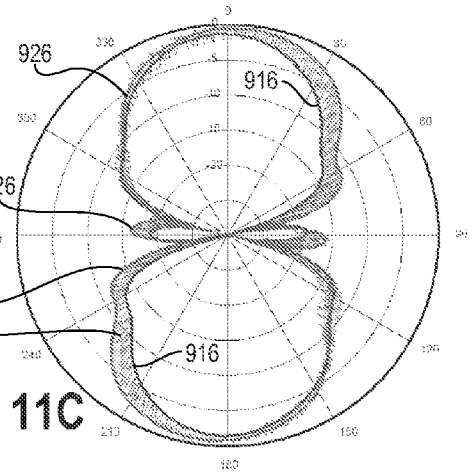
FIG. 11C
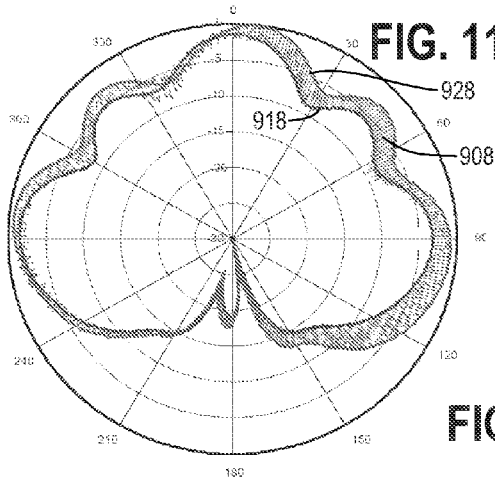
FIG. 11D
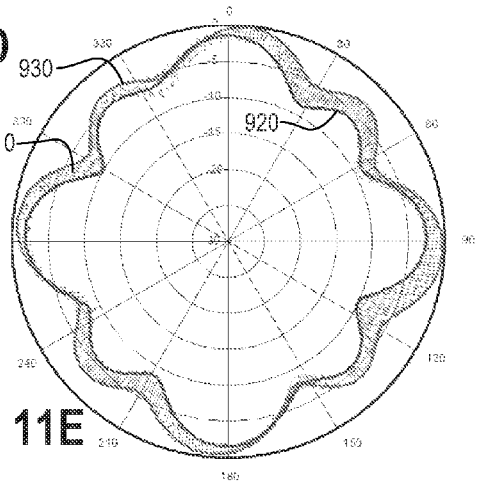
FIG. 11E

CIRCULARLY-POLARIZED ANTENNA

CROSS-REFERENCE TO RELATED APPLICATIONS

This application claims priority to U.S. Patent Application Ser. No. 61/183,734, filed on Jun. 3, 2009, the disclosure of which is incorporated herein by reference in its entirety.

FIELD OF THE INVENTION

The present invention relates generally to radio frequency (RF) electromagnetic signal broadcasting antennas. More particularly, the present invention relates to a circularly-polarized antenna for broadcasting.

BACKGROUND OF THE INVENTION

Low-cost mobile handheld devices require stable and clear entertainment video and audio reception, as well as high digital data rates. Circular polarization of broadcast signals reduces dependence on receiving antenna orientation for received signal strength, so that a simple dipole in virtually any orientation, for example, can receive a usable signal.

As in other broadcasting, it can be desirable to achieve particular extents of signal reception range, and to employ a small number of minimally-powered transmitters in the course of realizing that propagation. To these ends, radiating devices are preferably capable of exhibiting high gain and are preferably configurable with any of a variety of directionality options. Along with gain and propagation pattern, light weight and relatively small size may ease strength and wind load requirements for tower construction, allowing extra height above average terrain (HAAT), more bays, more radiators per bay, and the like.

Many broadcast antenna configurations exist. Configurations usable and of merit for many applications include elements referred to as patch radiators, positioned parallel to and separated from conductive backplanes. Typical known patch-radiator-based antennas are directional to a greater or lesser extent, and can produce a single pronounced lobe of emission in a principal direction (zero degrees relative to an axis perpendicular to the radiator centroid and directed away from the backplane), with emission to the sides (+/90 degrees with respect to the principal direction) and to the rear (180 degrees with respect to the principal direction) that decreases with increasing backplane size. Depending on details of design, individual patch antennas can be equally directional in azimuth and elevation, and can be configured in arrays that modify directionality.

Deficiencies in existing antenna designs for several broadcasting bands, including the 1.4 GHz band, may include excessive cost, narrow bandwidth capability (i.e., poor voltage standing wave ratio (VSWR), failure to extend over an entire allotted band, or even a substantial fraction thereof), lack of support for high broadcast transmitter power, variable and high wind load, and limited ability to provide circular polarization.

Some existing high power (up to 1 kW) circularly polarized antennas for bands near the 1.4 GHz band include crossed dipoles, log periodic radiators, slotted coaxes, and other styles. These styles can be so demanding to manufacture as to result in high cost for the achieved performance. They can also demand unique configurations for each unique propagation pattern. A generic style of circularly polarized antenna that allows diverse configuration and simplified installation could potentially achieve a much lower installed cost than available products without sacrifice of performance or reliability.

SUMMARY OF THE INVENTION

Embodiments of the present invention advantageously provide a circularly-polarized antenna that affords pattern versatility, reduced cost, broad bandwidth capability, and support for high broadcast transmitter power, low wind loading, and strong circular polarization.

In one embodiment, the circularly-polarized antenna includes a conductive backplane with a plurality of panels, a vertical array of patch radiators disposed on one of the backplane panels, and a feed stripline disposed on the backplane panel. The backplane panels are vertical, planar, rectangular and form a right prism. The vertical array has a radiator spacing of one wavelength, each radiator has a face and four edges, and each edge has a length of approximately one half wavelength. The feed stripline includes an input coupled to a coaxial feed cable, and a pair of outputs, orthogonal in position and phase, coupled to each of the radiators.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 4A is a side view and FIG. 4B is a face view of a feed stripline embodiment according to the invention disclosed herein.

FIG. 7A to FIG. 7D are azimuth radiation patterns for alternative embodiments of circularly polarized patch radiator array antennas according to the invention disclosed herein.

FIG. 8A to FIG. 8D are perspective views of alternative embodiments that emit the respective azimuth radiation patterns shown in FIG. 7.

FIG. 11A to FIG. 11E are azimuth radiation patterns for embodiments that incorporate the directing fins of FIG. 10 onto the alternative embodiments of FIG. 8.

DETAILED DESCRIPTION

Figure 1:
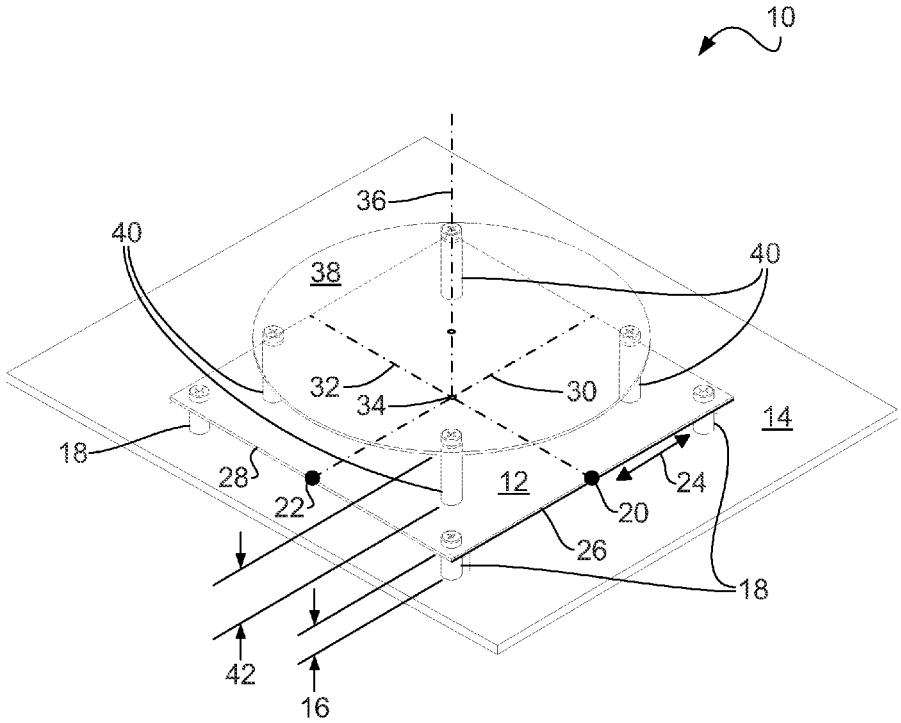
FIG. 1 is a perspective view of an embodiment of a patch radiator according to the invention disclosed herein.

The invention will now be described with reference to the drawing figures, in which like reference numerals refer to like parts throughout.

FIG. 1 is a perspective view of a single radiator 10 according to an embodiment that incorporates the invention. The directly-excited patch component 12 is shown positioned above and parallel to a segment of a backplane 14, by a patch height 16, using insulating standoffs 18 made from a material such as polytetrafluoroethylene (PTFE), polyethylene, or the like. For clarity, placement of the standoffs 18 (incorporating either nonmetallic screws as shown in FIG. 1 or other retention devices such as the barb clips shown in FIG. 4) is displaced from placement of corresponding fittings in succeeding figures, rather than being aligned with the standoffs for the parasitic, discussed below.

The patch component 12 is excited at nodes 20, 22 on the periphery 24 of the patch 12, at the midpoints of two orthogonal edges 26, 28, on two axes 30, 32 that cross at the center 34 of the patch component 12. In the embodiment shown, the patch component 12 is fabricated from thin sheet metal or a like conductive material, flat, approximately square, and about a half wavelength in length on each edge. The wavelength is calculated with respect to the center of the transmitted signal frequency range; in one embodiment, the transmitted signals are centered around 1.4 GHz. Patch height 16 is on the order of one tenth of a wavelength for the antenna, and the axes 30, 32 are orthogonal. It is to be understood that the placement of the nodes 20, 22 at loci intermediate between the center 34 and periphery 24, or at corners rather than at the midpoints of adjacent edges, may have attributes preferred in other embodiments, so that the placement shown should not be viewed as limiting.

Application of a common signal, having approximately equal magnitude but delayed by approximately 90 degrees for one of the two input nodes 20, 22 with respect to the other, causes the patch component 12, in conjunction with the backplane 14, to couple the applied signal into free space with a radiation pattern forming a far-field beam generally perpendicular to the backplane 14, passing approximately through the center 34 of the patch component 12, and coinciding with an axis of symmetry 36 of the patch component 12 (exclusive of node 20, 22 attachment accommodation). A beam so generated, having a single patch component 12, a backplane 14 of moderate size (zero backplane extent allows a peanut pattern, infinite backplane has zero back lobe), and no parasitic radiators exhibits circular polarization with low gain and with an axial ratio approaching unity.

FIG. 1 further shows a single, generally circular and flat, parasitic radiator 38, positioned by insulating standoffs 40, mounted with a broad face of the parasitic 38 parallel to and concentric with a broad face of the patch component 12 on the side distal to the backplane 14. Parasitic spacing 42 in the embodiment shown is on the order of and less than a quarter wavelength. Dimensions of the parasitic 38 are comparable to those of the patch component 12, with the parasitic 38 being thin sheet metal or like material having a diameter of approximately a half wavelength and a thickness dictated by structural considerations such as ease of manufacture, durability, and cost. The beam axis of the assembled element 10 generally coincides with the axis of symmetry 36 of the patch 12 and parasitic 38. As further addressed below, modifications to the design of the radiator 10 can cause properties such as orthogonality of the beam axis of the emitted signal to the backplane 14, and other features, to be altered.

Application of a signal to one of the input nodes 20, 22 results in a current density across the face of the patch 12 that decreases with increasing distance from the input node 20, 22. As a consequence, the radiated signal strength is somewhat asymmetrical. This phenomenon, with the beam axis deflected from the axis of symmetry 36, is popularly referred to as "squint." For an array of patches 12 oriented identically and thus fed with uniform orientation, the entire beam is deflected by the squint phenomenon. If the two input nodes 20, 22 on all patches 12 are oriented alike, the beam formed is circularly polarized, but is deflected both laterally and vertically. This is addressed further below.

Figure 2:
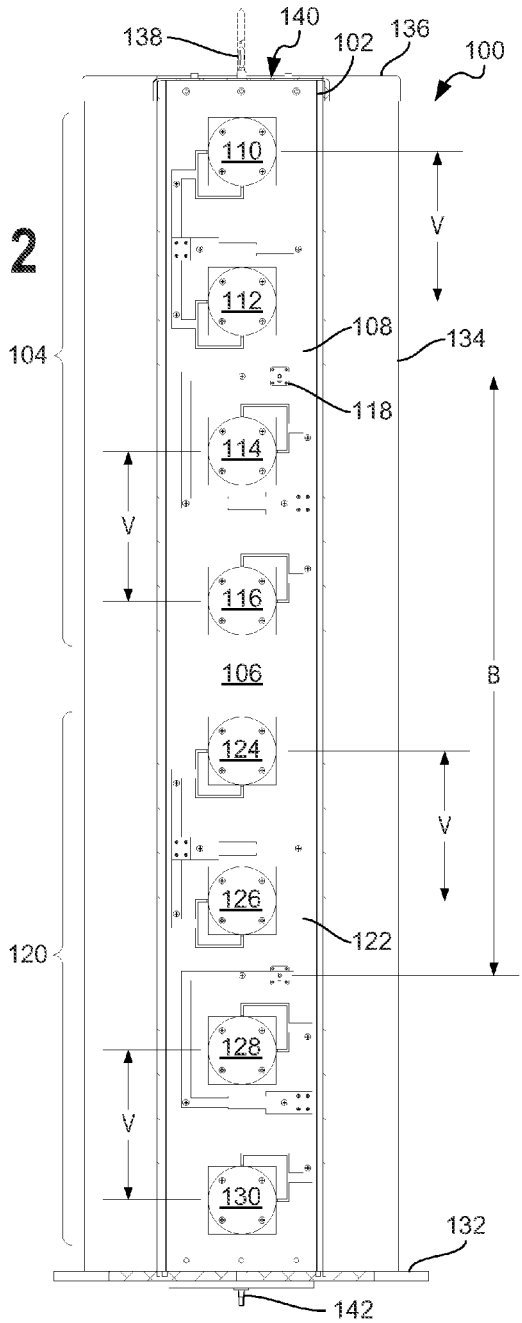
FIG. 2 is a perspective view of a single-face embodiment of a circularly polarized patch radiator array antenna according to the invention disclosed herein.

FIG. 2 is a first perspective view of a patch radiator array antenna 100 according to an embodiment of the invention disclosed herein. A circularly polarized antenna 100 employing a patch radiator array includes a conductive backplane 102, shown as a hollow right prism with optionally open base faces. The backplane 102 can be formed in some embodiments by cutting, bending, and/or welding flat stock of a conductive material, such as an alloy of aluminum compatible with those fabrication processes. In other embodiments, the backplane 102 can be extruded from compatible alloys in one or more sections, which can reduce fabrication steps. The antenna 100 further includes a first plurality of patch radiators disposed as a first regularly-spaced group 104 on a first vertical face or panel 106 of the conductive backplane 102, and a first feed stripline 108. In a preferred embodiment, the first group of patch radiators 104 includes four patch radiators 110, 112, 114, and 116. Any appropriate number of patch radiators can be configured as a group, depending on available signal power, desired beam pattern, available aperture height, and feed considerations. The first stripline 108 includes an input at a first feed point 118 in the conductive backplane 102, and orthogonal pairs of outputs on all of the radiators 110, 112, 114, and 116 of the first group 104. The first stripline 108 has a serpentine configuration, as is further discussed below.

The antenna 100 of FIG. 2 also includes a second plurality of patch radiators disposed as a second regularly-spaced group 120 on the first vertical face 106 of the conductive backplane 102, and a second feed stripline 122 arranged with respect to the second group 120 as is the first feed stripline 108 with respect to the first group 104. In a preferred embodiment, the second group 120 likewise includes four regularly-spaced patch radiators 124, 126, 128, and 130.

The single-faced antenna 100 further includes a mounting base 132, a surrounding radome 134, and a radome cap 136 that jointly establish weatherproofing to a greater or lesser extent. A lifting eye 138 is also shown; such a device, typically used for hoisting the assembled antenna 100, is preferably replaced with a lightning rod (overlaid in phantom) after installation in some embodiments. A radome cap 136, clamped to an end plate 140 terminating an upper extent of the backplane 102, can permit a suitably dimensioned radome 134—that is, a cylindrical tubular body having an inner diameter larger than a clearance diameter surrounding the backplane 102 and any larger-diameter components mounted thereon, and an outer diameter smaller than the inner diameter of the side wall of the cap 136—to move vertically above the base flange 132 without binding, accommodating differential thermal expansion.

Striplines 108, 122 electrically and communicatively connect the radiators to an external signal source via a power divider (not shown in this figure) and signal distribution lines such as the coaxial line 314 shown in FIG. 4. A single coaxial feed line from outside the antenna typically provides broadcast signal energy and can be mated to the antenna 100, such as by a coaxial connector 142 mounted on and penetrating the bottom of the antenna 100.

In other embodiments, the groups of radiators 104, 120 may be mounted on different faces 106 of the backplane 102, or there may be additional upper groups of radiators 104 and lower groups of radiators 120 distributed around a backplane 102, as determined by the required broadcast emission pattern for an installation.

Figure 3:
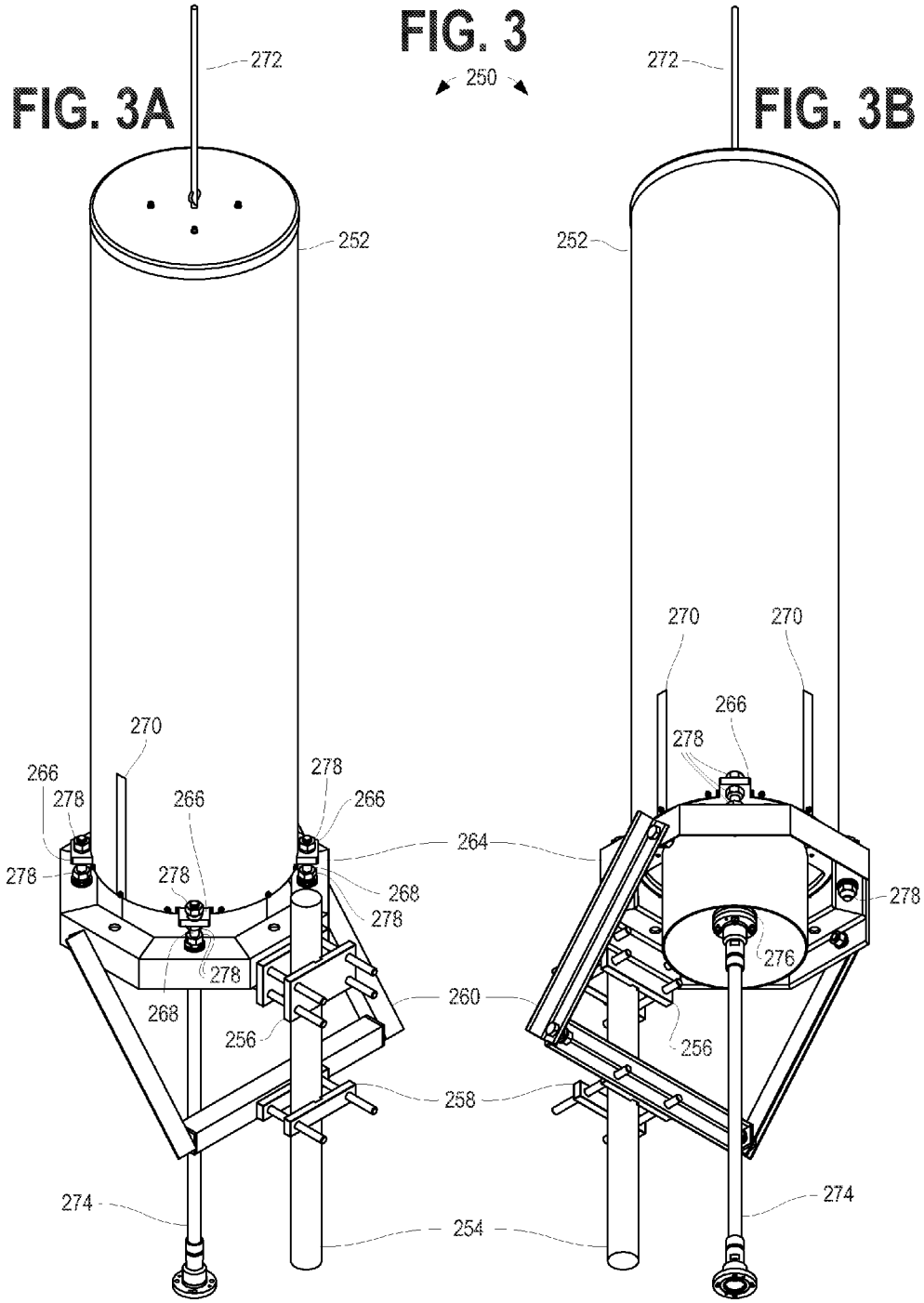
FIGS. 3A and 3B are perspective views of a fully assembled and mounted antenna.

FIG. 3 is a pair of perspective views 250 of a fully assembled and mounted antenna 252 attached to a structural element 254, of which a small segment is shown, by upper 256 and lower 258 clamps. The clamps 256, 258 are attached directly and by a brace 260 to a "squash plate" 264 that allows the mounting ears 266 of an antenna 252 to be fixed with mounting bolts 268 at any clocked 45 degree interval. The squash plate can thus be set where the structural element 254 and other parts of a tower (not shown) permit, with a narrow arc of adjustment, while the clocking of the antenna 252 allows radiation in any selected direction. Index marks 270 indicate radiation centers of populated faces of the antenna 252, and are omitted on unpopulated faces. This simplifies positive identification and correct orientation, particularly for applications wherein only the basic five population options, and constant beam tilt and null fill, are used.

FIG. 3 further shows a lightning rod 272, replacing the lifting eye 138 of FIG. 2 following mounting of the antenna 252. FIG. 3 further shows a pigtail 274, a length of flexible cable connected to the input port 276 of the antenna 252 in lieu of rigid, flange-connected elbows, allowing a user to install the system with less complexity The mounting bolts 268 can be "jackscrew" assemblies that include, in some embodiments, multiple nuts 278, washers, and associated components, and for which the bolts 268 may be headless, may be specialty products with socket fittings or heads with threaded portions on both ends, etc. With such arrangements, the four mounting ears 266 can be fastened to the squash plate 264 with varying spacing, so that the entire antenna 252 can be set plumb or tilted. Tilting of the antenna 252 allows yet another beam pattern option. For example, a strictly vertical antenna 252 having a particular pattern may traverse a restricted boundary. By tilting the antenna 252 by a small amount, the offending portion of the beam pattern can be directed to strike the ground short of an excluded zone, provided the opposite side of the pattern is not directed so high as to miss its intended coverage area.

FIG. 4 is a dual-view figure, including an edge view 3A and a layout view 3B, of a representative stripline 300, shown disposed above a section of a backplane 302, with the stripline 300 functioning to interconnect a group 304 of radiators 306, 308, 310, and 312, shown in phantom, according to an embodiment of the invention disclosed herein. A coaxial line 314, also shown in phantom, is routed within the box section of which the backplane 302 section is a part. The coaxial line 314 has an outer conductor 316 that terminates at the backplane 302 in a flanged and/or connectorized fitting 318, and an inner conductor 320 that extends through the fitting 318 to connect to the stripline 300 at a feed point 322. The fitting 318, if connectorized on its inward-oriented face (toward the middle of the backplane structure, away from the direction of propagation), can provide ready attachment for a coaxial line 314 that similarly includes a mating connector 324.

As illustrated in FIG. 4B, the stripline feed point 322 is offset laterally by a quarter wavelength D from the geometric center (coincident with a midpoint of a path along the stripline) 326 of the stripline 300. The offset D between the feed point 322 and the path midpoint 326 compensates for the rotation of element feed point placement between the upper elements 306, 308 and the lower elements 310, 312 of the group 304. A signal at a point 328 mirroring the feedpoint 322 is a half wavelength delayed with respect to the feed point 322, so that a signal propagating from the mirror point 328 to the upper pair of elements 306, 308, lags the signal that propagates from the feed point 322 to the lower pair of elements 310, 312 by 180 degrees in phase, thereby compensating for the respective pairs being rotated 180 degrees in space. Differential attenuation may be disregarded for some embodiments.

The stripline 300 has a serpentine configuration and has impedance controlled by its width W and its height H above the conductive backplane 302. A uniform stripline height H above the backplane 302 is maintained with insulating spacers 330. The spacers 330 have low enough physical bulk that their different dielectric constant has slight effect on impedance, as do the alterations in conductivity and impedance of the stripline 300 due to the holes 332 through which locking tips 334 of the spacers 330 pass. Alternative embodiments can be configured with adhesive-backed foam tape between the parts, with insulating clips that surround rather than passing through the stripline 300, or with other mounting arrangements, such as nonconducting screws, threaded mounting holes in the backplane, and the like, that afford comparable stability, uniformity of height H above the backplane, and impedance control.

Width W and height H above the backplane for the subordinate striplines 336, 338 leading away from the feed point 322 are preferably selected so that the impedance of the coaxial line 314 is half that of each, since the two subordinate striplines 336, 338 are electrically in parallel. Each subordinate stripline 336, 338 steps up twice 340 in width, with each step 340 functioning as a transformer, lowering the line impedance before the next (penultimate) tee junction 342 of each. The branches 344 after these tees 342 split again at final tees 346, with the widths of final legs 348, 350 reduced, providing higher impedance to match the higher impedance of the radiators 306, 308, 310, 312, as determined by their size and spacing J above the backplane 302, while lowering feed line current and raising radiator voltage. The lengths of the shorter 348 and longer 350 of the final legs differ by a quarter wavelength, providing excitation of the respective radiator drive nodes 352, 354 at 90 degree intervals, and inducing circular polarization in the signal radiated by the respective elements 306, 308, 310, and 312.

It is to be noted that the feed points to which the upper subordinate stripline 336 is directed are placed to the left and below, while those to which the lower subordinate stripline 338 is directed are placed to the right and above. The effect of this arrangement is to have the respective squint angles of the upper and lower pairs of radiators 306, 308 and 310, 312 offset each other. A beam formed from emissions having offsetting squint angles can have propagation axes that align more closely to the physical axes of the radiators than one formed from exactly parallel drive configurations, for example, while affording the feed stripline 300 rotational symmetry that can simplify component design and reduce the number of different parts required.

Other embodiments are feasible. While the embodiment shown in FIG. 4 is readily manufactured, relatively durable, and electrically efficient, feed striplines 300 can be more or less serpentine in form than that shown, routing of striplines 300 and the number and placement of transformers 340 can vary, feed can be directed to set squint angles in a different order, or all squint angles can be different instead of in pairs as shown. It is to be noted that the stripline distances to the respective radiator feed points are uniform with the exception of the distance from the feed point 322 to the mirror point 328. Travelling-wave or branch feed can be used in place of the corporate feed shown, albeit potentially changing bandwidth.

Figure 5:
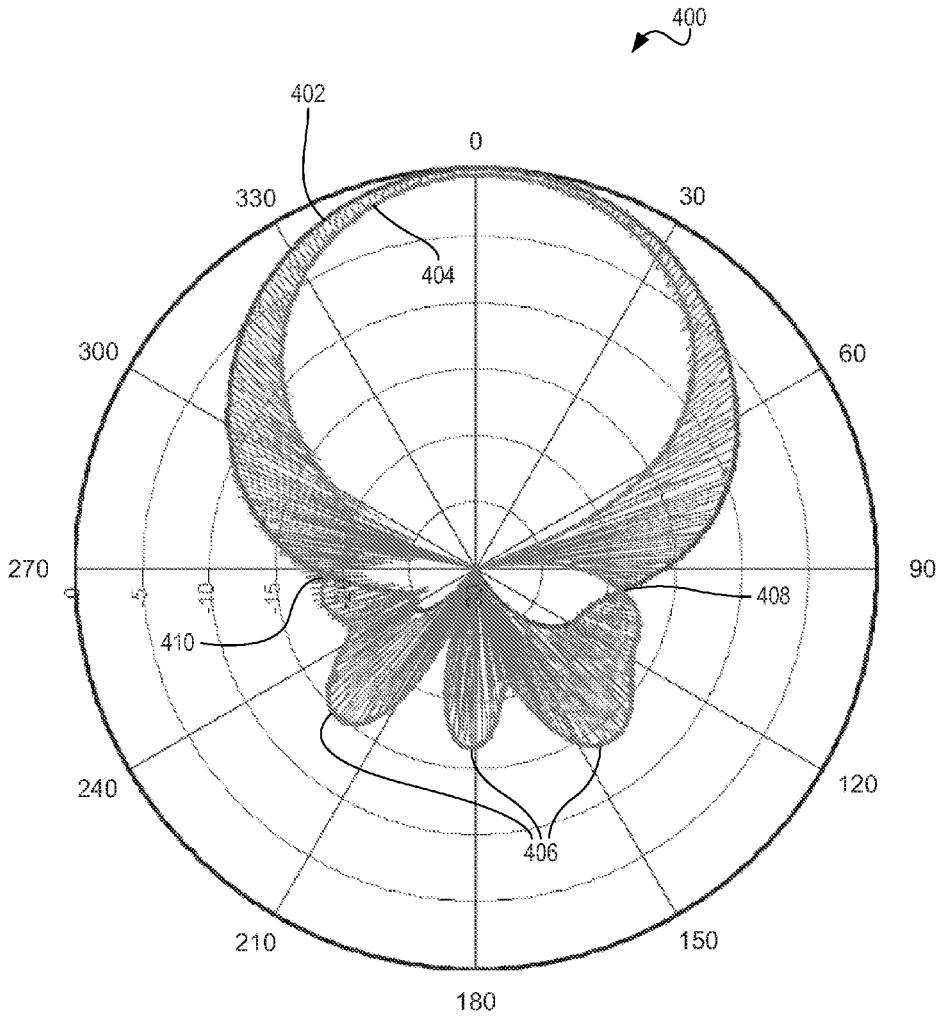
FIG. 5 is an azimuth radiation pattern for the embodiment of FIG. 2.

FIG. 5 is a chart 400 of signal strength versus azimuth for an embodiment in accordance with the arrangement of FIG. 2. The embodiment of FIG. 2 is an example of one of many possible configurations. The backplane 102 of FIG. 2 has a square horizontal cross section, and thus has four equal vertical faces and four long vertical edges. The first and second groups of patch radiators 104, 120 are equal in number. It should be noted, however, that the first and second groups of patch radiators 104, 120 may be different in number, from each other or from the embodiment shown, depending on the intended broadcast pattern, transmitter power, HAAT, aperture, beam tilt, etc. As shown in FIG. 5, signal strength of a single-face, eight-element antenna is strongly directional. The vertical 402 and horizontal 404 components radiated from an eight-element single-face antenna 100 as shown in FIG. 2 provide a directional signal with an azimuthal beam strength that decreases to 3 dB at approximately +/35 degrees from the peak direction, and 10 dB at approximately +/70 degrees from the peak direction, with a moderate axial ratio in all forward directions and some horizontally-polarized lobes 406 as strong as 16 dB behind the backplane 102.

Returning to FIG. 2, the vertical physical spacing within V and between B, along with the signal phasing between the first and second groups 104, 120 of patch radiators, may be adjusted to select beam tilt and null fill parameters, as appropriate for an installation. In a preferred embodiment, predrilling a backplane 102 establishes the inter-element vertical physical spacing within V groups 104, 120 from radiator to radiator 110, 112, 114, 116, and 124, 126, 128, 130, and permits predetermining locations and layouts for the striplines 108, 122.

Element spacing within V and between B groups 104, 120, viewed with reference to a transmitted signal wavelength may be selected as a design attribute by a product developer. Relative lengths of feed coaxes (such as the one 314 shown in phantom in FIG. 4) from the power divider (not shown) can be selected by an end user more readily than element spacing. Both sets of dimensions affect radiation characteristics of elements 110, 112, 114, 116, and 124, 126, 128, 130, and further define both beam tilt and null fill at least in part. A predrilled backplane 102 allows physical spacing, and with it antenna bandwidth limitations, to be fixed. Adjustments in phasing within and between groups 104, 120, as implemented through stripline geometry and differences in feed coax length, respectively, along with differential power distribution between groups 104, 120, permit selection of beam tilt and null fill over a range. Thus, an antenna 100 can be provided in kit form, using standard parts (each of which may have a small number of alternate forms), while allowing assembly to be both precise and tailored to a specific site.

Figure 6:
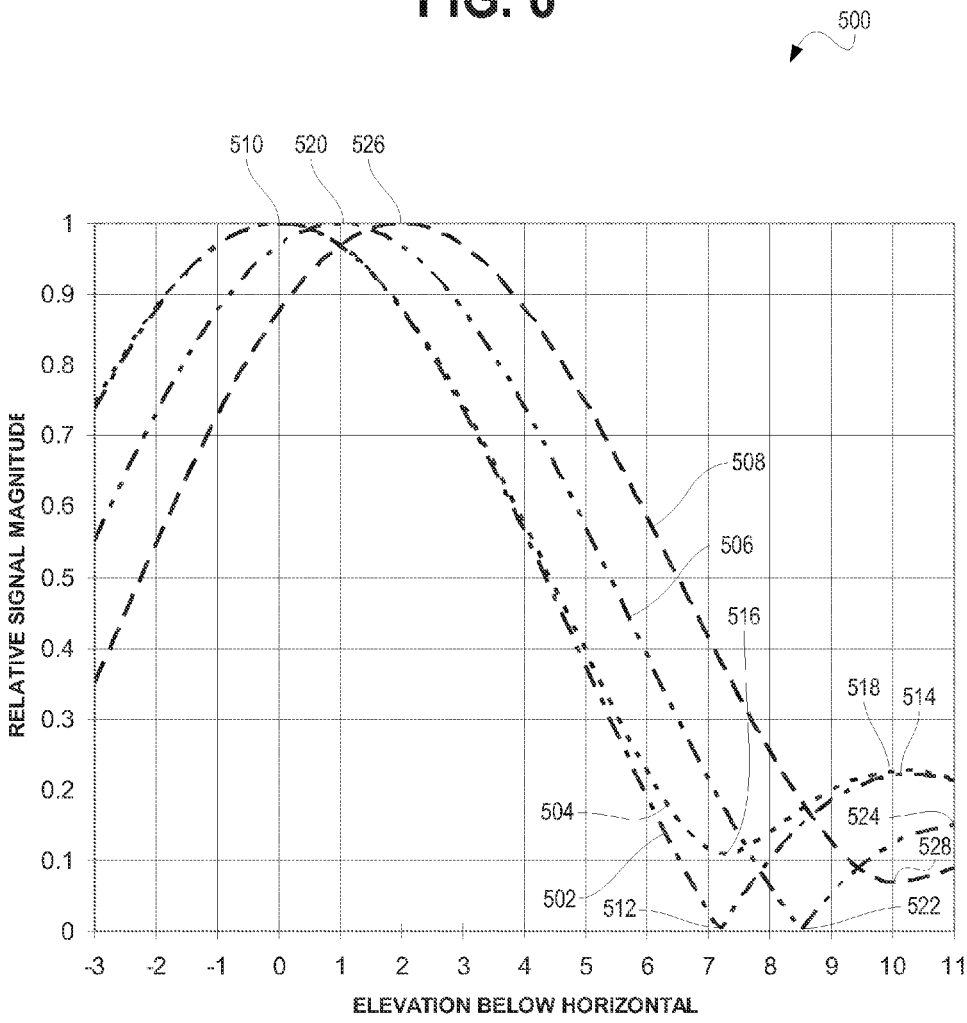
FIG. 6 is an elevation radiation pattern for the embodiment of FIG. 2.

FIG. 6 shows magnitude plots 500 of signal strength versus elevation. In one plot, a nominal feed phasing 502 (overlaid in part by another) is shown. In another, null fill has been introduced alone 504. In yet another, beam tilt has been introduced alone 506. In still another, both null fill and beam tilt are incorporated 508.

The nominal feed phasing plot 502 shows a maximum signal magnitude 510 at zero elevation with reference to the horizontal, a distinct null 512 due to cancellation by superposition of the radiated signals at slightly more than 7 degrees below the horizontal (note the caption and sign), and a slight second lobe 514 just beyond 10 degrees downward elevation. This is realized by driving all radiators with synchronous signals, so that optimum signal superposition occurs perpendicular to the backplane. This plot 502 is calculated without considering squint angle. As discussed above, it is to be understood that the squint angle phenomenon would deflect each radiator's beam by a small amount, with the extent and direction of deflection of each radiator's beam determined in part by the feed arrangement, and with the squint angles offsetting one another in some embodiments.

The null-fill plot 504 is nearly identical to the nominal plot 502 to about 5 degrees below horizontal, where it flattens so that the lowest magnitude 516 is about 20 dB down instead of having the signal effectively cancelled. The secondary peak 518 is slightly deflected from that of the nominal plot 502. An energy distribution of this type can be realized by dividing the available power from the transmitter unequally to the upper and lower groups 104, 120, within the power-handling limits of the hardware. For the embodiment shown, the power divider splits the signal in approximate 70:30 proportions, with the upper group 104 receiving the larger power level. This is readily realized with a variety of essentially lossless dividers, analogous to the tee junctions shown in the stripline 300, but with unequal junction output impedances providing differential power levels at split points and with transformers equalizing the final splitter output impedances.

It is to be understood that the null shown 512 can be significant for high-mounted antennas, such as those atop tall towers. For example, a null 7 degrees out from the aperture forms a ring of shadow at a distance of eight antenna heights—a 500 m tower can have poor reception 2.5 miles (4 km) away from the antenna for a short distance, with the null quite sensitive to receiver elevation. By contrast, a low-mounted antenna may have less need for null fill if its ring of shadow falls at a distance comparable to the size of a parking lot. For example, an antenna mounted at 100 ft (30 m) has a null around 800 ft (240 m) away, absent any reflective surfaces in the vicinity.

The beam-tilt plot 506 is also similar to the nominal plot 502, but has its peak 520 one degree lower than the nominal plot's peak 510, a null 522 shifted downward, i.e., toward the antenna base, by about 1.5 degrees, and a noticeably lower secondary peak 524. Hardware to realize this plot can, in some embodiments, have a strictly synchronous power divider, for example, along with a shorter coaxial feed line to the upper group 104 and a longer one to the lower group 120, thus delaying the signal applied to the lower group by a selected amount. With such a configuration, two multi-radiator signal peaks reach far field at different times, and the cumulative peak is lower and somewhat broader.

A guiding estimate for this antenna design is that a phase difference between the upper and lower coaxial lines of approximately 30 degrees results in a beam tilt of about one degree. It is to be understood that the difference in physical length of the lines to realize this differential phase depends on the propagation speed of the transmitter signals within the coaxes and the frequencies of the signals. For example, at 1.4 GHz, one wavelength is about 8.43 inches or 214 mm in free space. 30 degrees is 1/12 wavelength, 0.703 in., or 17.9 mm. Propagation velocity (velocity factor or VF), depending on cable properties, can be on the order of 0.66 to 0.89 of the speed of light for typical materials. Thus a lower cable on the order of 0.53 in. or 13 mm longer, with a VF of 0.75, tilts the beam around 1 degree downward.

Comparable behavior can be realized in some embodiments by changing the feed phase between all radiators instead of just the coax length. For example, for the serpentine stripline 300 shown in FIG. 4B, shifting of the feed point 322 with respect to the midpoint 326, elongating or shortening of the horizontal elements of the stripline 300, and changing of the relative lengths of the segments 344 from the penultimate tees 342 to the final tees 346, can adjust the propagation time to each of the radiators 306, 308, 310, 312 and thus the phasing therebetween. With the feed to the topmost radiator 306 the shortest and the feed to each successive radiator about 4 degrees longer, and with the lower coax about 16 degrees longer, the phasing is approximately the same as that for the above case, with beam broadening reduced. Such changes in phasing can be preset, and can be realized with prefabricated, standard components.

The combined beam-tilt and null-fill plot 508 shows the result of adjusting phasing about twice as much as shown on the beam-tilt plot 506 while also adjusting relative signal strength between the two groups. This both deflects the amplitude peak 526 downward to about 2 degrees and reduces the depth of a null 528 that occurs around 10 degrees below the horizontal. As noted above, the beam-tilt and null-fill adjustments are somewhat independent and can be selected separately. It is to be further understood that alteration of phasing between groups in antennas with more than two vertically arranged groups of radiators can alter beam tilt and null fill jointly, without modifying relative signal strength, even if phasing within each group is synchronous.

The calculated pattern of FIG. 6 is approximately realized at all azimuths in an omnidirectional antenna, and to some extent at all azimuths for any embodiment incorporating the inventive apparatus. The plot does not address relative magnitude of horizontal and vertical components of signal strength, and thus does not address ellipticity as a function of elevation.

FIG. 7 shows four examples of broadcast emission patterns in addition to that of FIG. 5. These patterns are, respectively, cardioid, FIG. 7A (a principal lobe 602 exceeding 5 dB over about 180 degrees and exceeding 10 dB over about 270 degrees), a peanut pattern, FIG. 7B (two opposite lobes 604 and 606, each similar to the single lobe 402 of FIG. 5, with side lobes 608 and 610 roughly filling in to about 15 dB for most azimuths), a so-called broad cardioid, FIG. 7C (a principal lobe 612 exceeding 5 dB over about 270 degrees and 10 dB over about 300 degrees), and an omnidirectional pattern, FIG. 7D (generally better than 5 dB in all directions). The elevation signal strength remains much as indicated in FIG. 6 for all of these, with magnitude scaled to the unity reference in FIG. 6.

Each of the patterns of FIG. 7 can be realized by a different modification of the antenna 100 of FIG. 1. In addition, still other patterns can be realized.

FIG. 8 is a perspective view of four additional antenna embodiments of the invention disclosed herein, each realizing a corresponding radiation pattern of FIG. 7. In FIG. 8A, radiators 702, 704 are positioned on two adjacent faces 706, 708 of the backplane 710, which realizes the cardioid of FIG. 7A. In FIG. 8B, radiators 712, 714 are on two opposite faces 716, 718 of the backplane 720, instead of adjacent faces, resulting in the peanut pattern shown in FIG. 7B. FIG. 8C includes radiators 722, 724, 726 on three faces 728, 730, 732 of the backplane 734, providing the broad cardioid of FIG. 7C, while FIG. 8D populates all four faces 736, 738, 740, 742 of the backplane 744, and realizes the omnidirectional pattern shown in FIG. 7D.

Each of the embodiments shown in FIG. 8 is fully populated on the indicated faces. In still other embodiments, fewer radiators may be placed on one or more faces, such as single groups of four, groups of two or one, and the like. As mentioned above, element placement greatly exceeding the one-wavelength vertical spacing shown can introduce grating lobes, and with them noticeable reception artifacts such as closely-spaced strong and null signal regions in elevation. Taller antennas, having three or four groups, or more, in each vertical array, are readily realized. As the number of driven elements on each face varies from the baseline number shown, signal power handling capability and antenna gain change proportionately. Such changes likewise affect the emission patterns of FIGS. 4, 5, and 6, sharpening individual beams and deepening nulls between as the numbers of radiators increase. Adjustment of relative signal power level and phase to each group remains a factor in controlling beam tilt and null fill for all of the embodiments of FIG. 8.

It is to be understood that the actual signal power at each azimuth in the far field tends to increase with the number of elements, even where the relative strength at an azimuth may be less. Similarly, increases in transmitter power, within the capability of the power divider and the individual radiators, increase far-field signal strength, although with less effect on radiation pattern than those caused by altering the number and/or spacing of elements. Unequal population of the faces of the backplane 710, 720, 734, and 744, unequal power distribution between faces or between groups within a face, and varied phasing between faces or between groups result in beam patterns related to those of FIGS. 4, 5, and 6, but varying according to the population and phasing of and applied power to each face.

An end user can select among the five embodiments illustrated, matching the effective beam patterns to the terrain coverage requirements of particular single-frequency networks or other applications, and scaling the selected beam pattern by HAAT, tower top versus mid-tower aperture positioning, and transmitter power to provide coverage. Where further refinement is needed, an antenna vendor can further adjust the transmitted beam patterns by changing the number of radiators on each face, by selecting power divider parameters to make the power division non-uniform, by assigning multiple values of phase delay to the signals applied to respective groups of radiators, by increasing the number of groups above two per face, and the like. The vendor can then perform analysis on each such variant, such as with ray tracing software, and provide an expanded catalog of beam pattern charts for an end user to select among. The above-indicated variations can all use the same standard components. Where still further refinement is needed, phase adjustment within groups can be added, in some embodiments without altering backplane hole patterns, thus retaining the "kit" attribute of the invention.

Legal or local restrictions on ERP as well as utility cost and equipment stress can affect tradeoffs between transmitter power and antenna size. As aperture height, represented by the number of radiators per face, increases, gain generally increases, so that peak signal strength at each azimuth, and ERP, also increase even if transmitter power output per face remains essentially constant. As a tradeoff, the elevation beam pattern is typically flattened, that is, signal strength above and below the peak elevation decreases more rapidly with angle. This characteristic adds another performance consideration in selecting antenna configuration. Equipment stress refers to increases in failure rates of electronic devices such as transmitters as output drive or other properties approach rated maximum values. Stress can be nonlinear, increasing abruptly near maximum capability, so that modest power reduction can appreciably improve reliability.

Antennas according to embodiments of the invention exhibit elliptical polarization. Circular polarization occurs at crossovers 408, 410, 614, 616, 618, and 620, between vertical and horizontal predominance in the propagation pattern shown in FIGS. 4 and 6. Over all azimuths and elevations, ellipticity tends to vary within a range, as indicated in the charts of FIGS. 4 and 6. Polarization can approach circular over large ranges of azimuth for some combinations of patch shape, radiator spacing away from the backplane, backplane size, stripline design, stripline termination placement on each patch, parasitic size, shape, and spacing away from the patch, vertical spacing between elements, phasing accuracy between elements, and other variables. It is to be understood that circular polarization is not always optimal for broadcasting from fixed base stations to mobile receivers. Experiments have shown that having about twice the signal strength in a horizontal component as in a vertical component (i.e., the vertical is at 3 dB) can improve margins in some strongly depolarized environments, although circular polarization is consistently adequate and is to be preferred in many environments.

Figure 9:
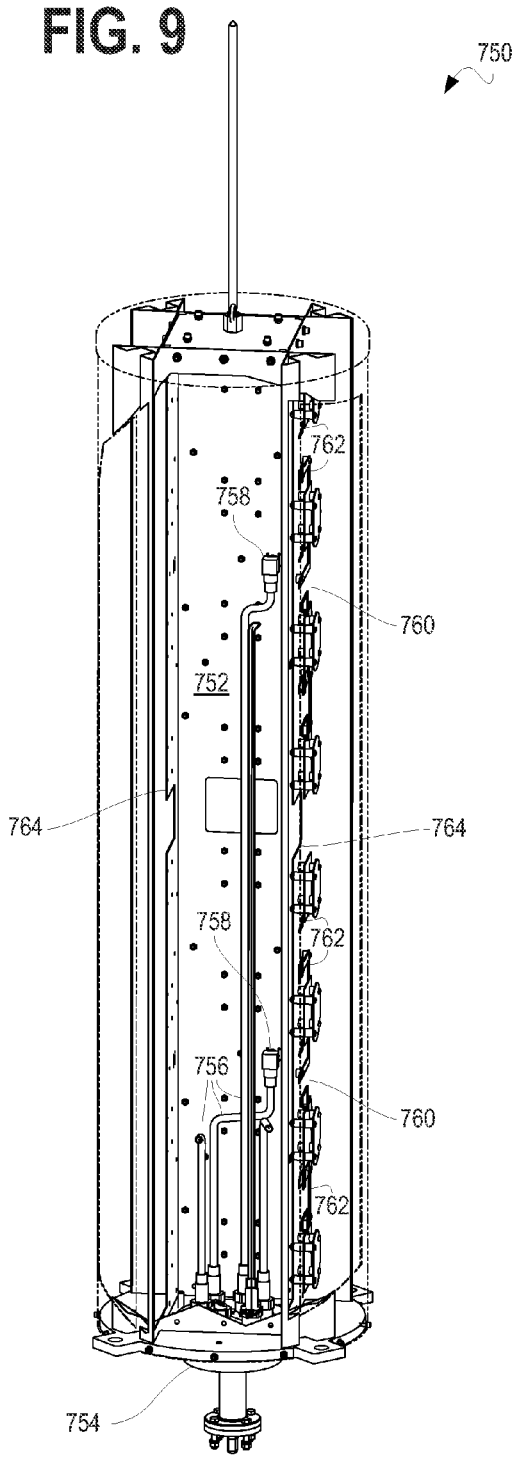
FIG. 9 is a perspective cutaway view of an antenna according to the invention disclosed herein.

FIG. 9 is a perspective cutaway view of an antenna 750 that shows internal wiring within the backplane 752, including a power splitter 754 and a plurality of coaxial feed cables 756 from the splitter 754. The cables 756 are routed to the locations on the backplane 752 where penetrations 758 pass the signals from the cables 756 through to the feed points 760, and then to the striplines 762. This general layout applies to backplanes 752 with any number of faces 764, and with any number of those faces 764 populated. The splitter 754 shown provides six-way splitting (the face at the left is unpopulated, the missing face (closest to the viewer) is populated).

Feed power level to the pair of coaxial cables 756 serving each face 764 of the backplane 752 can be the same as the level to the other pairs or different. Feed power level within each pair can likewise be equal (50:50), or 70:30, or another ratio, as determined by user requirements and the amount of electrical beam tilt desired. Changing relative lengths of cables 756 making up each pair can establish null fill for their face 764, while changing relative lengths from face to face 764, by altering phasing rather than providing synchronous excitation of all radiators, allows further adjustment of the five nominal beam patterns as needed.

It is to be understood that the beams from adjacent faces 764 produce a combined pattern, particularly in the areas of greatest overlap, as can be seen by comparing the patterns of FIGS. 5 and 7A. The pattern of FIG. 7A represents beams transmitted synchronously and directed at roughly +/−45 degree angles to the zero-degree reference azimuth. It may be observed that grouped radiators, as shown in FIG. 8A, for example, are separated spatially by a significant fraction of a wavelength, so their combined signal pattern, as shown in FIG. 7A, does not correspond to a pattern generated by superposition of signals from directional point sources. Further altering the relative phase of beams from adjacent faces, such as by using cables 765 of different lengths, affects signal reinforcement at all azimuths, and thus beam patterns.

The term "axial ratio" generally refers to an extent to which an antenna approximates strictly circular polarization. As used herein, axial ratio is defined as the ratio of the received signal strength of a linearly polarized component of a signal at the polarization orientation that shows the minimum signal level to the signal strength of the component at the orientation orthogonal thereto. This gives a maximum value of 1.0 for an ideal (circularly polarized) signal. Axial ratio has a value that may vary continuously with azimuth. Axial ratio affects both the transmitter power level needed for coverage and receiving antenna sensitivity to orientation. The term "polarization ratio" is defined as the ratio of vertical polarization to horizontal polarization at every azimuth. The gain charts of FIGS. 5, 7, and 11 combine axial ratio plots with horizontal and vertical signal strength plots that imply polarization ratios. In FIG. 5, the axial ratio plot 410 generally falls within boundaries formed by the horizontal 402 and vertical 404 signal strength plots, implying that the axial ratio ellipse substantially overlays the polarization ratio ellipse. This is not as consistently true for the charts of FIGS. 7 and 11, suggesting that the interaction of the beams for some azimuths is more complex than for others.

Figure 10:
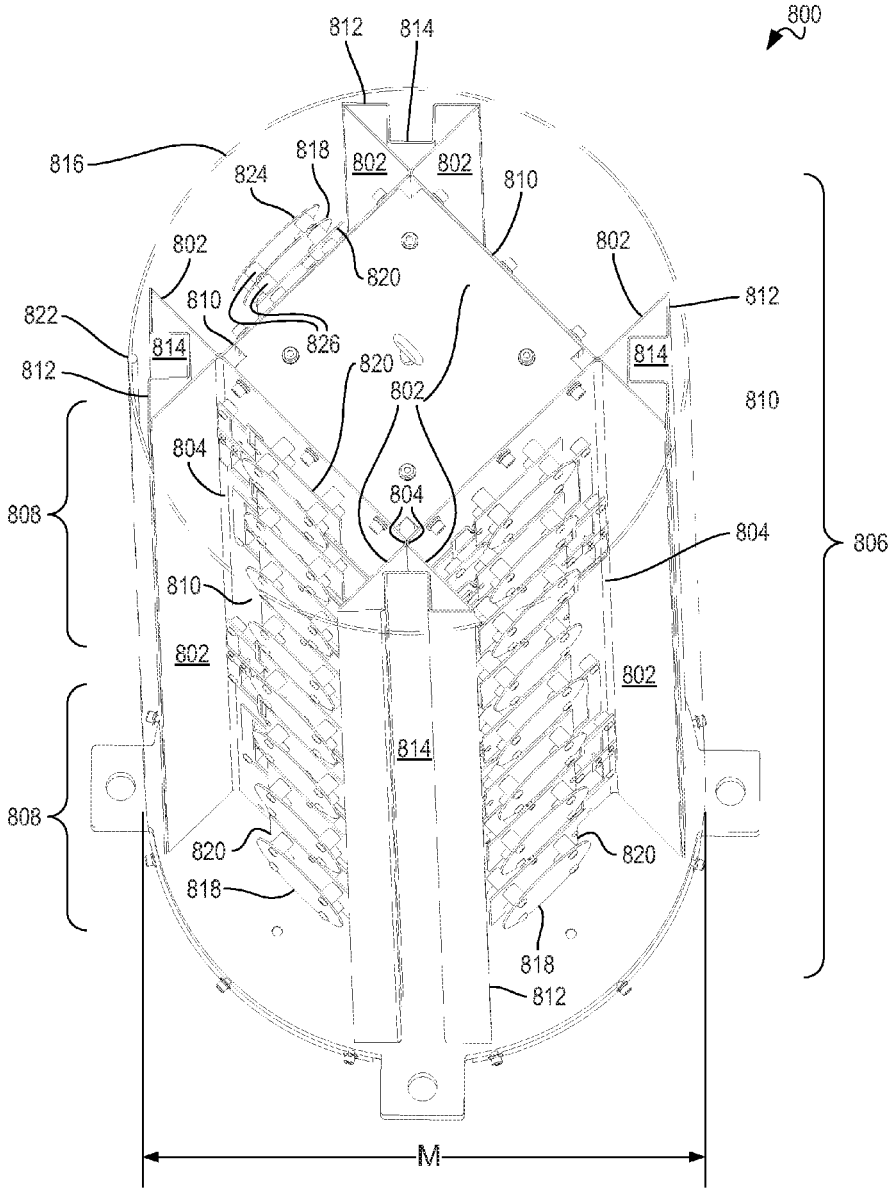
FIG. 10 is a perspective view of an embodiment of a circularly polarized patch radiator array antenna having directing fins according to the invention disclosed herein.

FIG. 10 is a perspective view of one representative antenna 800 incorporating an aspect of the invention wherein at least one directing fin 802 is installed along or integral with each edge 804 of the backplane 806. The directing fins 802 function in azimuth in a fashion similar to that of basket reflectors in both azimuth and elevation in some other directional antennas. In particular, the directing fins 802 narrow the range of azimuth over which propagation occurs for each radiator group 808, while causing the axial ratio of the radiated signal to be more closely controlled over the effective azimuths. The antenna shown in FIG. 10 is representative; groups 808 mounted on faces 810 of the backplane 806 are partially walled in by the directing fins 802, resulting in a proportional narrowing of beams formed by those groups 808 and reduced interaction between beams from each face, as well as providing axial ratios that are more uniform with azimuth.

The hat sections 812 bridging the distal extents of the directing fins 802, as shown in FIG. 10, represent one embodiment of an inductive stub termination, or choke, for each backplane face 810, with the dimensions and angle of the recess 814 serving with the directing fins 802 to narrow the vertical component and broaden the horizontal component of the beam from each face.

The particular configuration of the directing fins 802 and chokes 812 shown in FIG. 10 should be viewed as one of many that can be effective to a greater or lesser extent, and is not to be viewed as limiting. Directing fins 802 can be formed by bending out extended portions of each face 810 as shown, by forming the entire backplane with fins as a single extrusion, by attaching separate extruded or fabricated pieces at the respective edges 746 of the square prism backplanes 710, 720, 734, and 744 of FIG. 8, for example, such as by welding, by providing mating flanges that allow screws, rivets, clips, or other appropriate fastenings to assemble multiple parts, by adding continuous recesses along the edges of square prism backplanes 710, 720, 734, and 744 into which flanges of directing fins functionally equivalent to those of FIG. 10 can insert, and by other methods. It should be noted that the as-assembled electrical continuity of a backplane can affect directing fin effectiveness—that is, poor or irregular joints can introduce spurious radiation.

The presence of directing fins 802 typically increases the diameter M of a radome 816 needed to envelop the radiators of an antenna 800 having a backplane 806 of a given face size. Since the largest radome clearance diameter needed for antennas such as those of FIGS. 2 and 6—that is, lacking directing fins 802—is typically defined by backplane size and parasitic radiators 818 placement, addition thereto of relatively small directing fins (not shown) may not affect radome diameter M. However, the usefulness of the directing fins 802 can be shown to depend in part on their size and configuration, including space allowance to each side from the radiators 820 to the fins 802. Thus fin dimensions can influence backplane 806 size over at least a limited range. As a result, a radome 816 of larger diameter M, and thus capable of accommodating larger directing fins 802 and/or a wider-faced backplane 806, may be preferable to a smaller radome 816 for a given set of radiator groups 808.

While cost and weight of a tube part of a radome 816 can increase with diameter D, wall thickness may be reduced with increased diameter while maintaining strength, so availability of radome tube stock having particular properties may be a significant factor in developing a detailed design. A radome 816 tube part formed from flat stock and joined by gluing or plastic welding, forming a seam 822 as shown, can render this consideration moot. Another limiting factor can be wind loading, which increases very approximately linearly with diameter D for a radome 816 of a given height having a largely uniform cylindrical body.

Once tradeoffs over sizes of backplanes 806, fins 802, and radomes 816 have been resolved, sufficient excess radiator 820 clearance distal to the backplane 806 within the radome 816 may be present to allow the addition of at least one additional parasitic 824 (shown in phantom in one place) on each radiator 820. Issues to be evaluated include cost, weight, and performance benefit. Additional parasitic radiators 824 may be equal in materials, dimensions, and spacing to the first parasitics 818. That is, spacing from each square patch 820 to a first parasitic 818, and from the first parasitic 818 to a second parasitic 824, may be approximately equal. The second parasitics 824 and the mounting hardware 826 establishing spacing between components may likewise be similar or identical to corresponding first-parasitic components as dictated by user-selected details of beam formation.

FIG. 11 is a multiple-configuration plot 900 that illustrates azimuth beam patterns corresponding to those of FIGS. 4 and 6, retaining the single-parasitic 38 configuration shown in FIG. 1, modified by the addition of the directing fins 802 shown in FIG. 10 to each antenna configuration. The above statements regarding the ability of directing fins 802 to increase uniformity of axial ratio 902, 904, 906, 908, and 910 (the saw tooth amplitude trace seen between the outer and inner boundaries defined by vertical 912, 914, 916, 918, and 920, and horizontal 922, 924, 926, 928, and 930 emission magnitude traces) may be seen to be confirmed by this experimental data. It is to be further understood that the increased uniformity—i.e., reduced radial excursion—of axial ratio can be shown to enhance probability of reception, corresponding to effective range, when compared to an antenna without directing fins 802, for a transmitting antenna directed toward a receiver, such as a mobile device having a receiving antenna. However, in view of other considerations, such as cost, size, or ERP restrictions for a specific embodiment, an antenna without fins, or with fins larger, smaller, or differently-oriented than those optimizing axial ratio, may be preferred.

Figure 12:
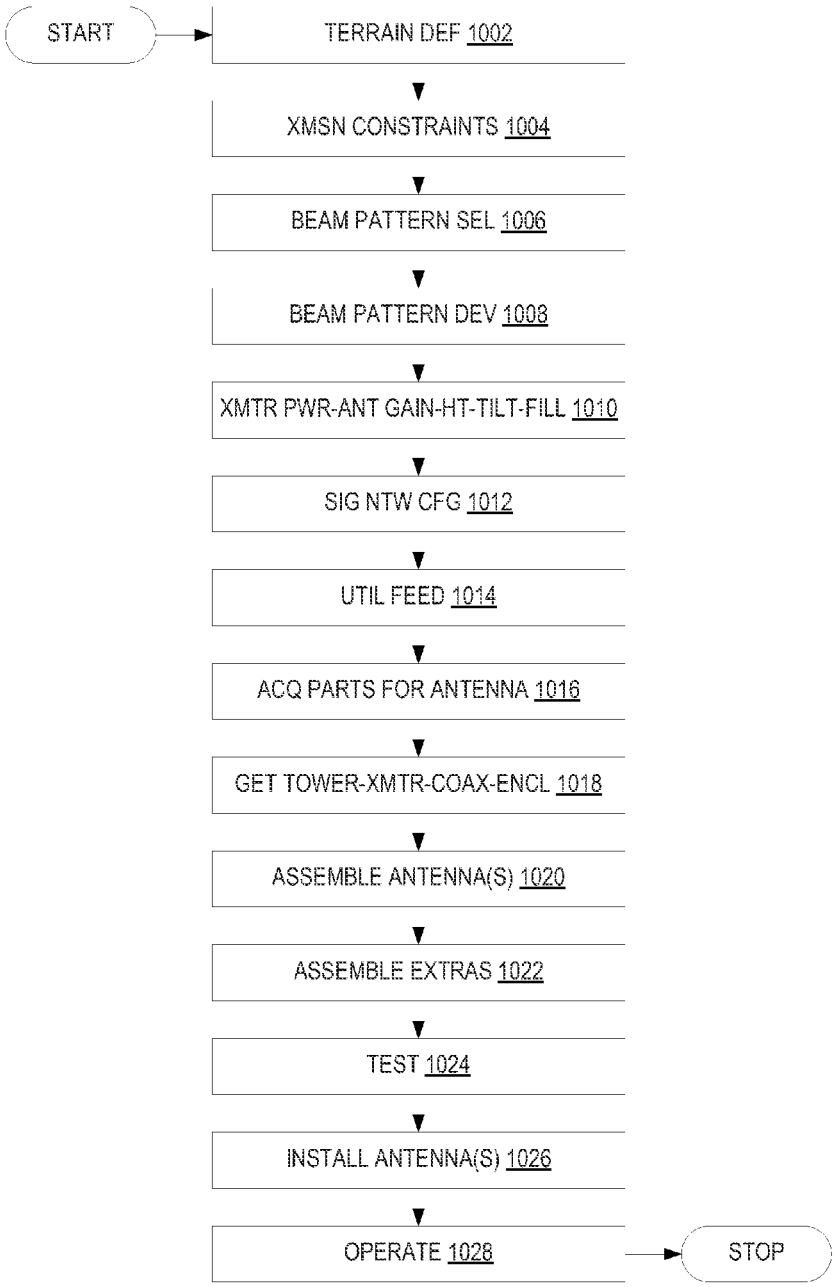
FIG. 12 is a flow chart of a method of establishing a broadcasting system incorporating circularly polarized patch radiator array antennas according to the invention disclosed herein.

FIG. 12 is a flowchart 1000 describing a method of defining and assembling a high-power circularly polarized patch radiator array antenna, system, or network according to an embodiment of the invention disclosed herein. The method identifies 1002 a terrain region to be served by one or more broadcast antennas. Characteristics of the terrain region include size, general outline shape, and propagation irregularities (such as soil conductivity, bodies of water, large buildings and related structures, large land features, and general terrain slope). The method further identifies transmission constraints 1004, such as regulated effective radiated power (ERP) limits, regulated tower height limits, adjacent (interfering) broadcast areas, tower site placement and/or available tower aperture restrictions, and no-go features (such as national borders).

The method further selects a beam pattern or patterns 1006 that admit of scaling and rotating to provide a broadcasting footprint conformal to the terrain region, based on the range of available patterns in FIGS. 3, 5, and 8. The method further stipulates 1008 any requirements for extensions to or deviations from the selected pattern or patterns. The method further selects 1010 antenna attributes such as transmitter power output, antenna gain, antenna height, beam tilt, and null fill satisfying the requirements. The method further configures 1012 a communication and distribution network for routing low-level (station output) signals from sources to the antenna sites in the network. The method further arranges 1014 for utility feeds for electrical power, water, telephone service, and other housekeeping needs for transmitters sited at the antennas.

The method further acquires 1016 component parts from which antennas having the selected radiative and environmental attributes can be assembled. The method further acquires 1018 towers and/or tower top or aperture assignments, mounting provisions, transmitters, transmitter enclosures, coaxial signal lines, and the like, as needed for each site. The method further assembles 1020 the antennas for the respective sites, where the antennas each include a core component set that includes at least one backplane, base flange, top cap, and radome, where the antennas each further include at lease one radiator group having at least one coaxial feed line, at least one stripline with associated feed node and standoffs, and at least one radiative element with associated standoffs and parasitic element.

The method further assembles any extras 1022, that may include, depending on details, any number of additional radiator groups and auxiliary parasitics, and, for a nonzero number of additional radiator groups, at least one corporate-feed power distribution device with associated transmitter signal input interface and associated phase-determining signal distribution coaxial feed lines, and may further include a lifting eye and/or lightning rod, provision for the backplane to have directing fins, and a test facility. The method further tests 1024 and performs any needed corrective action for the as-built antenna. The method further places 1026 the built and tested antenna/antennas in its/their assigned aperture(s), and performs final interconnection of the components, broadcast testing, and application for permits and licenses. The method further operates 1026 and periodically reports to competent authority, to include license renewal as required.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A circularly-polarized antenna, comprising:

a conductive backplane including a plurality of vertical, planar, rectangular panels forming a right prism;

a vertical array of equally-sized, planar patch radiators, disposed on one of the backplane panels and having a radiator spacing of one wavelength, each radiator having a face and four edges, each edge having a length of approximately one half wavelength;

a feed stripline, disposed on the backplane panel, having an input coupled to a coaxial feed cable, and a pair of outputs, orthogonal in position and phase, coupled to each of the radiators;

a second vertical array of equally-sized, planar patch radiators, disposed on one of the backplane panels and having a radiator spacing of one wavelength, each radiator having a face and four edges, each edge having a length of approximately one half wavelength;

a second feed stripline, disposed on the backplane panel, having an input coupled to a coaxial feed cable, and a pair of outputs, orthogonal in position and phase, coupled to each of the radiators; and a power splitter including a single input and a plurality of outputs, each coupled to an input of the feed striplines, wherein the power splitter provides an unequal power distribution to the feed striplines.

2. The antenna of claim 1, wherein the conductive backplane has a square cross section.

3. The antenna of claim 1, wherein the number of radiators in each array is the same.

4. The antenna of claim 1, wherein the vertical arrays are disposed on the same backplane panel.

5. The antenna of claim 1, wherein the vertical arrays are disposed on adjacent backplane panels.

6. The antenna of claim 1, wherein the vertical arrays are disposed on opposite backplane panels.

7. The antenna of claim 1, wherein the backplane includes a pair of parallel directing fins extending orthogonal to the backplane panel, on opposite sides of, and equidistant from, the vertical array.

8. The antenna of claim 1, wherein each backplane panel includes at least one pair of parallel, directing fins extending orthogonal thereto.

9. The antenna of claim 1, further comprising a parasitic radiator, having a diameter of approximately one half wavelength, disposed above each patch radiator by one quarter wavelength or less.

10. The antenna of claim 1, further comprising a parasitic radiator, having a diameter of approximately one half wavelength, disposed above each patch radiator by one quarter wavelength or less.

11. The antenna of claim 1, further comprising a radome enclosing the backplane, radiators, and feed stripline.

* * * * *